US005274859A

United States Patent [19]

Redman et al.

[11] Patent Number: 5,274,859

[45] Date of Patent: Jan. 4, 1994

[54] SHOWER SPLASH SHIELD

[75] Inventors: Leon E. Redman, Bloomfield Hills; Roger W. Murphy, Milford; Bruce W. Higgins, South Lyon, all of Mich.

[73] Assignee: Brass-Craft Manufacturing Company, Southfield, Mich.

[21] Appl. No.: 992,218

[22] Filed: Dec. 17, 1992

[51] Int. Cl.[5] ..... A47K 3/22

[52] U.S. Cl. ..... 4/608; 4/609; 160/349.1; 24/458

[58] Field of Search ..... 4/558, 559, 605, 608, 4/609; 160/349.1, 349.2, DIG.; 24/458, 555, 530, 67.11

[56] References Cited

U.S. PATENT DOCUMENTS

| | | | |
|---|---|---|---|
| D. 253,188 | 10/1979 | Baugus | D23/307 |
| D. 297,454 | 8/1988 | Walton | D23/307 |
| 609,965 | 8/1898 | Kelsey | 160/349.2 X |
| 939,487 | 11/1909 | Fish | 24/458 X |
| 2,347,234 | 4/1944 | Allen | 160/349.2 X |
| 2,631,663 | 3/1953 | Malkin | 160/349.2 |
| 3,724,000 | 4/1973 | Eakman | 4/609 |
| 3,855,642 | 12/1974 | Blitch | 4/609 |
| 3,879,806 | 4/1975 | Armstrong | 4/608 X |
| 3,984,880 | 10/1976 | Schrameyer | 4/609 |
| 4,189,790 | 2/1980 | Masters, III | 4/609 X |
| 4,759,087 | 7/1988 | Zeilinger | 4/605 |
| 4,771,517 | 9/1988 | Bonanno | 4/609 X |
| 4,825,481 | 5/1989 | Lonberger | 4/608 |
| 4,944,050 | 7/1990 | Shames et al. | 4/609 |

*Primary Examiner*—Henry J. Recla
*Assistant Examiner*—Robert M. Fetsuga
*Attorney, Agent, or Firm*—Myron B. Kapustij; Malcolm L. Sutherland

[57] ABSTRACT

A bathtub shower splash shield member which includes a shower curtain holding structure adapted for use with a bathtub for preventing water from a shower head from splashing between a wall and the adjacent side of a suspended shower curtain, member comprised of a generally triangular shaped unitary body containing two general orthogonally arranged mounting legs that intersect at a vertex and a web extending between and joining mounting legs. The two mounting legs include a vertically extending leg adapted to be mounted on a wall structure and a horizontally extending leg adapted to be mounted on the flat horizontal surface of a side wall of the bathtub. The shower curtain holding structure includes an opening extending through vertically extending leg and a finger clamp disposed in this opening. The finger clamp includes a clamping portion extending in a direction away from first leg. The clamping portion cooperates with the web to grip a portion of the curtain between the clamping portion and the web.

12 Claims, 1 Drawing Sheet

SHOWER SPLASH SHIELD

FIELD OF THE INVENTION

This invention relates to a bathtub shower splash shield for use in conjunction with a shower curtain to keep water from splashing into the floor adjacent a bathtub when a person is taking a shower.

BACKGROUND OF THE INVENTION

A bathtub is usually located in an alcove with an end wall of the alcove at each end of the bathtub. A curtain rod with a shower curtain suspended therefrom usually extends across the space between the two end walls. The shower curtain extends downwardly into the bathtub below the top rim of the tub. Due to the inwardly curved interior shape of the ends of the bathtub there is normally a gap between the end walls and the shower curtain which is offset from the end walls by said inward curvature of the tub. When taking a shower water may splash through this gap onto the bathroom floor.

It is also possible that the bathtub may not be precisely perpendicular to one or both of the end walls. This further contributes to the formation or enlargement of the gap between the edge of the shower curtain and the end wall.

This invention provides a simple, easy to install splash shield which eliminates this gap and prevents water from splashing onto the bathroom floor.

SUMMARY OF THE INVENTION

According to the invention, the shower splash shield is comprised of a generally vertically extending leg, a generally horizontally extending leg which is joined to said vertically extending leg and is generally perpendicular thereto, and a flat web portion lying between and joining the legs. The vertically extending leg mounts the splash shield to an end wall of the alcove enclosing the bathtub, while the horizontally extending leg mounts the splash guard onto the bathtub. Openings are provided in the vertically extending leg in one of which openings is mounted a finger clamp which clamps and holds the shower curtain between the clamp and the web.

DETAILED DESCRIPTION OF THE PREFERRED EMBODIMENT

Figure 1:
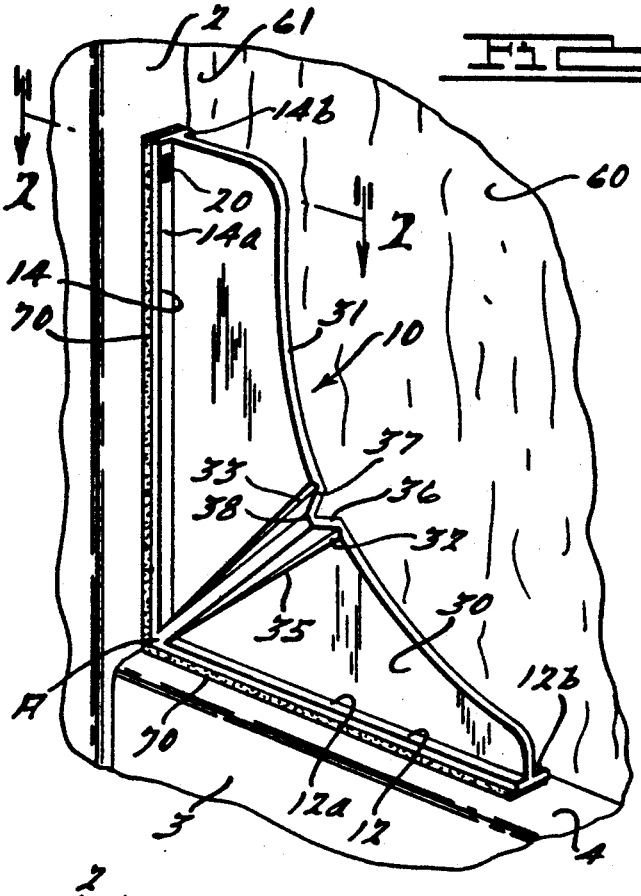
FIG. 1 is a fragmentary perspective view of one end of a bathtub, end wall and shower curtain with the shower splash shield in its installed position with the shower curtain captured and held on the interior side of the shower splash shield.

In FIG. 1 there is shown a tub/shower stall including a first end wall 2 and a second end wall (not shown) generally parallel to and opposite the first end wall 2. A tub 3 is disposed between the first and second end walls. The tub 3 includes a top marginal edge 4. The shower splash shield 10 is mounted between the end wall 2 and the top edge 4 of the tub. The shower splash shield 10 extends upwardly from the top marginal edge 4 of the tub 3 and abuts against end wall 2. A curtain 60 is suspended from a suitable support such as a curtain rod (not shown) extending between the end walls.

The shower splash shield 10 is comprised of two legs 12 and 14. The two legs 12 and 14 intersect at vertex A and are generally orthogonally arranged with respect to each other and are used to mount the shower splash shield to the tub 3 and to the end wall 2. More specifically leg 12 is used to mount the shower splash shield 10 to the top marginal edge 4 of the tub and leg 14 is used to mount the shower splash shield to the end wall 2.

A generally triangular shaped web or body portion 30 intersects each of elongated legs 12 and 14 about mid-width of each leg, and lies in a plane that is substantially perpendicular to the legs 12 and 14. Web 30 is formed of a substantially flat, relatively thin, and substantially rigid sheet material such as plastic and is solid, i.e., has no openings therethrough.

A fold 35 is provided in the web 30. The fold 35 functions as a pleat and includes two segments 36 and 37 that join at edge 38. Fold 35 extends from vertex A to the opposite portion of the free edge 31 of the web 30 that is closest to the vertex. Where the sections 36, 37 of the fold join the web 35, grooves 32 and 33 are provided to facilitate folding of the fold 35. The fold functions as an expansion and contraction joint which accommodates variations from vertical in the angular attitude of the end wall 2 to which leg 14 of the splash shield 10 is attached.

If the angle between the end wall 2 and the top edge 4 of the tub 3 is less than 90 degrees, the fold 35 will contract or close, accordion style, thereby allowing the vertex A to have an angle less than 90 degrees, i.e., generally the same angle as the angle between the end wall 2 and the top edge 4 of the tub. If the angle between the end wall 2 and the top edge 4 is greater than 90 degrees, the fold 35 will expand or open, accordion style, allowing vertex A to have an angle greater than 90 degrees, i.e, generally the same angle as the angle between the end wall 2 and the top edge 4 of tub 3.

As previously stated web 30 intersects the two legs 12 and 14 at approximately mid-width, thereby forming two sections on each leg, one on either side of web 30. Thus the intersection of web 30 with leg 12 forms sections 12*a* and 12*b*, while the intersection web 30 with leg 14 forms sections 14*a* and 14*b*.

Figure 2:
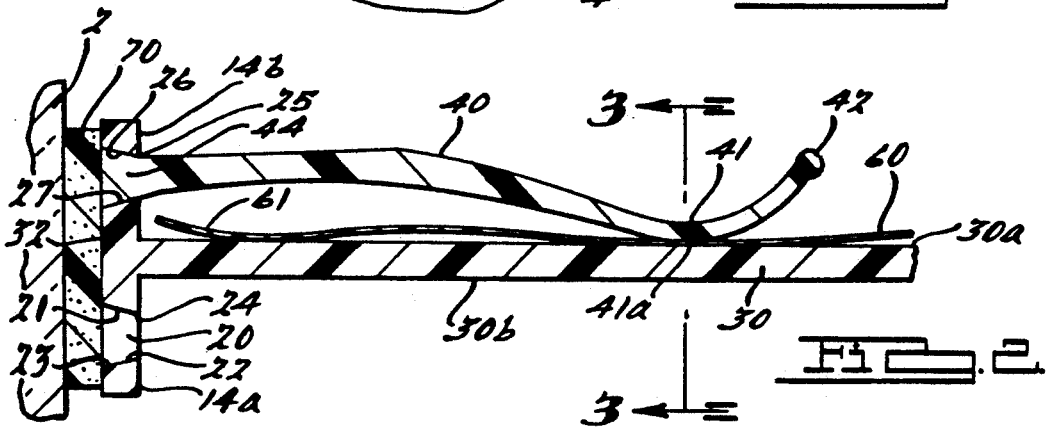
FIG. 2 is a fragmentary sectional view taken along line 2—2 of FIG. 1.

The shower splash shield also includes means for gripping and holding a shower curtain 60. This means includes finger clip 40 (as best illustrated in FIG. 2) which is curved at 41 toward web 30 adjacent its distal end 42. The curved section 41 of finger 40 is in intimate, surface to surface contact with the inside wall 30*a* of web 30.

By applying a lateral force to distal end 42 of finger 40, in a direction away from the inside wall 30*a* of web 30, curved section 41 will be moved out of contact with side wall 30*a* of web 30, so that the free edge 61 of shower curtain 60 can be slipped past the distal end 42 and past the curved section 41 of clip 40. When the distal end 42 is released, the finger 40 is restored to its original position as shown in FIG. 2 due to the resiliency of the material comprising clip 40. Curtain 60 is then captured and held by pressure and friction between the curved section 41 of the finger 40 and the side wall 30*a* of web 30. The inside 41*a* of curved section can be textured or roughened so as to aid in holding the curtain in place.

Web 30 and legs 12 and 14 are preferably molded as a unitary piece or body. They are comprised of a plastic, preferably a thermoplastic material. Finger 40, however, is separate from the body which is comprised of web 30 and legs 12 and 14.

Figure 4:
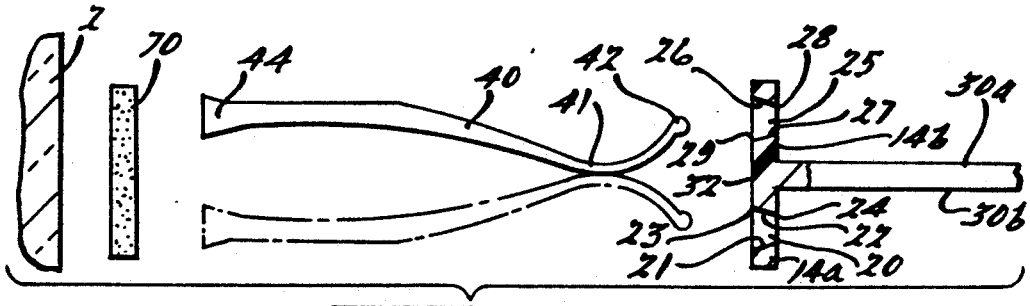
FIG. 4 is an exploded top plan view with part of the vertical leg broken away to show the opening in the vertical leg which receives the finger clamp.

As illustrated in FIG. 4 finger 40 can be disposed adjacent either side wall 30*a* or side wall 30*b* of web 30.

Figure 3:
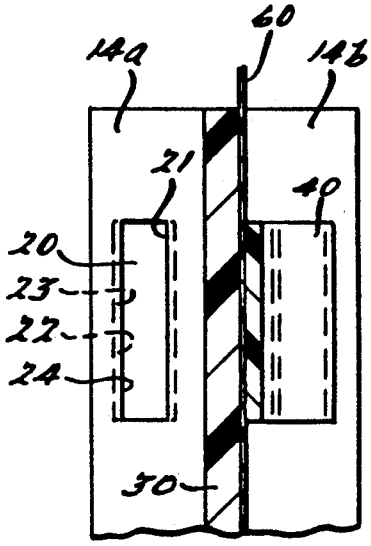
FIG. 3 is a view taken along line 3—3 of FIG. 2.

An opening 20 is provided in section 14*a* of leg 14, and another opening 25 is provided in section 14*b* of leg 14. Openings 20 and 25 extend through sections 14*a* and 14*b* adjacent the upper portion of sections 14*a* and 14*b*. As best illustrated in FIGS. 2 and 3 openings 20 and 25 are generally rectangular in shape and have side walls 21, 22 and 26, 27 which are tapered toward the front. Side walls 21 and 22 taper toward the front 24 of opening 20, with the front 24 of opening 20 being narrower than the back 23 of opening 20. Likewise, side walls 26 and 27 of opening 25 taper toward the front 28 of opening 25, with the front 25 of opening 25 being narrower than the back 29 of opening 25.

This tapered shape of openings 20 and 2 results in the complementary shaped rear portion 44 of the finger 40 dovetailing into the opening by the finger clamp 40 being inserted into the opening 25 through its rear 29. The finger 40 is prevented from exiting the openings 20 or 25 through their forward ends 24 or 28 respectively because of the tapered shape of its base 44 dovetailing with the tapered openings 20 and 25.

An adherent strip 70, which is adherent on both its surfaces, engages the underside of the legs 12 and 14 and adheres leg 12 to the top edge 4 of the tub 3 and leg 14 to end wall 2. As illustrated in FIG. 2 the adherent strip 70 also secures the base 44 of finger 40 within opening 25 or 20 and keeps it from falling out through the rear 23 of opening 20 or the rear 29 of opening 25. The adherent strip 70 is normally applied onto the legs after the finger clamp 40 has been inserted into opening 20 or 25. This strip is a pressure sensitive adhesive material which is well known to those skilled in the art and is readily commercially available as, for example, from Minnesota Mining and Manufacturing.

As illustrated in FIG. 4 finger clamp 40 can be inserted through and captured in either opening 25 or in opening 20. If finger clamp 40 is inserted through opening 25 the shower splash shield 10 may be disposed is illustrated in FIGS. 1-3. If it is desired to dispose the shower splash shield 10 against the second end wall, i.e., the wall opposite end wall 2, the finger clamp 40 is inserted through opening 20 and the splash shield is rotated 180° from the position shower in FIG. 1. Thus, depending upon the placement of the finger clamp 40 the shower shield can be disposed either in the left hand corner (as shown is FIG. 1) or in the right hand corner (opposite the left hand corner and not shown) and can serve as either a left hand or right hand shower splash shield. This obviates the necessity for manufacturing, packaging and stocking two different models, i.e., a left handed model and a right handed model, of the splash shield.

The shower shield of the instant invention can be easily and quickly installed without the need of any tools.

Although the invention has been shown and described with respect to a certain preferred enbodiment, it is to be understood that certain alterations and modifications may occur to those skilled in the art. The present invention includes all such equivalent alterations and modifications.

What is claimed is:

1. A shower splash shield adapted for use with a bathtub for preventing water from a shower head from splashing between a wall and the adjacent side of a suspended shower curtain comprising:
   - a first vertically extending mounting leg;
   - a second horizontally extending mounting leg joined to said first leg;
   - a web extending between and joining said first and second legs, said first leg provided with at least one vertically extending section disposed on at least one side of said web;
   - said second leg adapted to overlie and be attached to a portion of a horizontal top surface of a side wall of a bathtub;
   - said first leg adapted to overlie and be attached to an upright wall adjacent which one end of the bathtub is located;
   - an opening extending through said at least one vertically extending section of said first leg; and
   - a clamping finger comprising a base and a clamping section, said base being disposed in said opening with said clamping section extending from said base in a direction away from said first leg and cooperating with said web to grip a portion of the shower curtain between said clamping section and said web with said portion of said shower curtain sandwiched between and in intimate contact with said web and said clamping section.

2. The shield of claim 1 wherein said opening extending through said at least one vertically extending section of said first leg is spaced away from said web.

3. The shield of claim 1 wherein said clamping section includes a curved portion which is in intimate contact with said web.

4. The shield of claim 1 wherein said web divides said first leg into two vertically extending sections with a second opening extending through the second of said two vertically extending sections.

5. The shield of claim 1 wherein said opening is tapered, being wider at the wall attachment side than at the finger extending side.

6. The shield of claim 5 wherein said base is in a dovetail relationship with said opening.

7. The shield of claim 6 wherein said web is solid.

8. The shield of claim 1 wherein said first and second mounting legs are joined at a vertex defined by the junction of adjacent ends of said first and second mounting legs.

9. The shield of claim 8 wherein said web is shaped to provide a pleat section that extends from said vertex to a portion of the free edge of the web to provide and expansion joint which accommodates variations in the angular altitude of the wall to which said first mounting leg attaches.

10. The shield of claim 9 wherein said pleat extends from said vertex to a portion of the free edge of the web that is closest to and opposite from said vertex.

11. The shield of claim 1 wherein an adhesive strip is secured along substantially the entire lengths of said first and second mounting legs so as to provide the attachment of said first mounting leg to said wall and said second mounting leg to the horizontal top surface of a side wall of said bathtub.

12. The shield of claim 1 wherein said web is solid.

* * * * *